US009957772B2

(12) United States Patent
Tennant

(10) Patent No.: US 9,957,772 B2
(45) Date of Patent: May 1, 2018

(54) VALVE ASSEMBLY

(71) Applicant: Expro North Sea Limited, Dyce, Aberdeenshire (GB)

(72) Inventor: Alan Tennant, Drum (GB)

(73) Assignee: Expro North Sea Limited, Dyce (GB)

( * ) Notice: Subject to any disclaimer, the term of this patent is extended or adjusted under 35 U.S.C. 154(b) by 0 days. days.

(21) Appl. No.: 15/024,680

(22) PCT Filed: Oct. 7, 2014

(86) PCT No.: PCT/GB2014/053011
§ 371 (c)(1),
(2) Date: Mar. 24, 2016

(87) PCT Pub. No.: WO2015/052498
PCT Pub. Date: Apr. 16, 2015

(65) Prior Publication Data

US 2016/0215584 A1 Jul. 28, 2016

(30) Foreign Application Priority Data

Oct. 8, 2013 (GB) ..... 1317799.3

(51) Int. Cl.

| | |
|---|---|
| ***E21B 29/04*** | (2006.01) |
| ***E21B 29/08*** | (2006.01) |
| ***E21B 29/12*** | (2006.01) |
| ***E21B 33/064*** | (2006.01) |
| ***E21B 34/04*** | (2006.01) |
| *E21B 34/00* | (2006.01) |

(52) U.S. Cl.
CPC ..... *E21B 33/064* (2013.01); *E21B 29/04* (2013.01); *E21B 29/08* (2013.01); *E21B 34/04* (2013.01); *E21B 2034/002* (2013.01)

(58) Field of Classification Search
CPC ..... E21B 29/04; E21B 29/08; E21B 29/12; E21B 33/064; E21B 34/04; E21B 2034/002
See application file for complete search history.

(56) References Cited

U.S. PATENT DOCUMENTS 3,356,145 A * 12/1967 Fredd ..... E21B 23/02 166/322
3,533,430 A * 10/1970 Fredd ..... E21B 34/08 137/112
3,747,618 A * 7/1973 Boes ..... E21B 29/04 137/486
3,934,606 A * 1/1976 Matthews ..... F16K 5/204 137/454.6
3,967,647 A * 7/1976 Young ..... E21B 29/04 137/614.11

(Continued)

*Primary Examiner* — Matthew R Buck

(57) ABSTRACT

A valve assembly for wellbore, downhole or intervention operations, such as for subsea wellbore operations includes a rotatable valve member having a passage formed therein. The valve assembly is reconfigurable between a first configuration in which the passage is aligned or alignable with a first conduit, and a second configuration in which the passage is misaligned or misalignable with the first conduit, so as to cut or sever and/or clamp apparatus present in the valve member passage prior to reconfiguration. The assembly is configured to apply a maximum cutting force at a particular phase or stage of the reconfiguration.

18 Claims, 6 Drawing Sheets

(56) References Cited

U.S. PATENT DOCUMENTS

| | | | | | |
|---|---|---|---|---|---|
| 3,971,438 | A * | 7/1976 | Crowe | E21B 34/101 | 137/460 |
| 4,160,478 | A * | 7/1979 | Calhoun | E21B 29/04 | 166/319 |
| 4,519,576 | A * | 5/1985 | Winegeart | E21B 21/106 | 166/321 |
| 4,700,782 | A * | 10/1987 | Read | E21B 34/12 | 166/330 |
| 5,284,209 | A * | 2/1994 | Godfrey | E21B 29/04 | 166/336 |
| 5,551,665 | A * | 9/1996 | Noack | E21B 29/04 | 166/324 |
| 6,152,229 | A * | 11/2000 | Jennings | E21B 29/04 | 137/613 |
| 7,510,002 | B2 * | 3/2009 | Brown | E21B 33/061 | 166/330 |
| 7,963,339 | B2 * | 6/2011 | Cowie | E21B 34/10 | 166/332.3 |
| 8,066,075 | B2 * | 11/2011 | Cowie | E21B 33/035 | 166/332.3 |
| 8,662,183 | B1 * | 3/2014 | Vickio, Jr. | E21B 29/08 | 166/361 |
| 9,410,391 | B2 * | 8/2016 | Guven | E21B 29/04 | |
| 9,453,388 | B2 * | 9/2016 | Tahoun | E21B 21/103 | |
| 2010/0051847 | A1 * | 3/2010 | Mailand | E21B 29/04 | 251/288 |
| 2013/0081823 | A1 * | 4/2013 | Wood | E21B 29/04 | 166/373 |

* cited by examiner

VALVE ASSEMBLY

This application is entitled to the benefit of, and incorporates by reference essential subject matter disclosed in PCT Application No. PCT/GB2014/053011 filed Oct. 7, 2014, which claims priority to Great Britain Application No. 1317799.3 filed Oct. 8, 2013, which applications are herein incorporated by reference.

BACKGROUND OF THE INVENTION

1. Technical Field

The present invention relates to a valve assembly and associated methods for use in wellbore, downhole or intervention operations, such as for subsea wellbore operations. In particular, but not exclusively, the invention relates to a connection between a subsea riser and a subsea wellhead.

2. Background Information

Subsea operations often involve the connection of a surface vessel or platform to a subsea wellhead via a riser. Safety valves having a shearing arrangement are commonly used to cut objects such as wireline, slickline, coiled tubing, tooling and/or the like which may extend through the riser to the wellhead during subsea operations and to isolate the riser from the wellhead in an emergency. For example, Blow-out Preventers (BOP) are commonly installed as part of permanent infrastructure which is located at a subsea wellhead. BOP's typically have rams with cutting plates to shear objects such as wireline, slickline, coiled tubing, tooling and/or the like which extends through the riser.

For a lightweight subsea riser, for example for use with lightweight intervention tooling, there may be no permanent subsea safety valve. Instead, a well control package may be connected in the riser tubing string, wherein the well control package comprises a valve assembly for cutting the wireline, slickline, coiled tubing, tooling and/or the like and for sealing the riser from the wellhead to prevent fluid flow from the wellhead to the riser.

Ball valve assemblies are known which comprise first and second conduits and a ball valve member having a through-hole foamed therein, wherein the ball valve member is mounted between respective ends of the first and second conduits for rotation about a valve member rotational axis between an open position in which the through-hole of the ball valve member is aligned with the ends of the first and second conduits and a closed position in which the ball valve member is misaligned with the ends of the first and second conduits and creates a seal therebetween. Such ball valve assemblies may be configured to shear wireline, slickline, coiled tubing, tooling and/or the like extending through the first and second conduits and the valve member through-hole as the ball valve member is rotated towards the closed position. For example, U.S. Pat. No. 3,971,438, incorporated herein by reference, discloses a tubular housing and a ball valve assembly housed within the housing, the ball valve assembly comprising a ball valve member having slots which are eccentrically located with respect to a rotational axis of the ball valve member. A hydraulically actuated annular piston is located around the ball valve member. Pins extend radially with respect to a longitudinal axis of the valve assembly between the ball valve member and the annular piston. In operation, the piston is hydraulically actuated along the longitudinal axis and a force is transferred between the piston and the ball valve member through the pin and slot arrangements for rotation of the ball valve member.

This background serves only to set a scene to allow a skilled reader to better appreciate the following description. Therefore, none of the above discussion should necessarily be taken as an acknowledgement that that discussion is part of the state of the art or is common general knowledge. One or more aspects/embodiments of the invention may or may not address one or more of the background issues.

SUMMARY OF THE INVENTION

According to a first aspect of the present invention there is provided a valve assembly for wellbore, downhole or intervention operations, such as for subsea wellbore operations. The valve assembly may comprise a rotatable valve member having a passage formed therein. In a first configuration of the valve assembly, the passage may be aligned or alignable with a first conduit. In a second configuration of the valve assembly, the passage may be misaligned or misalignable with the first conduit. The valve assembly may be reconfigurable between the first configuration and the second configuration so as to cut or sever and/or clamp apparatus present in the valve member passage prior to reconfiguration. The assembly may be configured to apply a maximum cutting force at a particular phase or stage of the reconfiguration.

The passage may be alignable with a longitudinal axis of the first conduit such that fluid and/or apparatus may pass through the valve assembly. The passage may be misalignable to cut or sever and/or clamp apparatus in the passage. The passage may be misalignable with the longitudinal axis of the first conduit such that a passage/transit of a fluid and/or apparatus through the valve assembly is substantially prevented or at least impeded. The valve assembly may be configured to cut or sever and/or clamp apparatus in the passage.

Reconfiguration of the valve assembly from the first configuration to the second configuration may cut or sever and/or clamp apparatus present in the valve member passage prior to reconfiguration. The particular phase or stage of the reconfiguration may comprise when a maximum cutting force is required to cut or sever the apparatus. The assembly may be configured to apply a maximum cutting force via the valve member when the maximum cutting force is required to cut or sever the apparatus. The assembly may be configured to apply a maximum cutting force via the valve member at a stage of reconfiguration when the valve member is most likely to encounter a maximum resistance to cutting. The particular phase or stage may correspond to a dimension of apparatus, such as a width of apparatus to be passed through the passage (e.g. a diameter of coiled tubing or the like). The assembly may be configured to initiate the particular phase or stage at an anticipated or predetermined separation of a moving cutting edge (e.g. of the valve member) from a cooperating cutting edge or cutting edge support (e.g. a fixed valve seat). The predetermined separation may correspond to a dimension of the apparatus.

The first configuration may comprise a valve open position. The second configuration may comprise a valve closed position.

Reconfiguration of the valve assembly from the first configuration to the second configuration may seal the valve assembly such that fluid passage/transit through the valve assembly is substantially prevented.

The particular phase or stage may comprise a cutting phase or stage. The particular phase or stage of the reconfiguration may comprise an end phase or stage. The particular phase or stage of the reconfiguration may comprise a closing phase or stage, such as towards and/or at a phase or stage when the passage is ultimately closing and/or closed. The particular phase or stage of the reconfiguration may comprise a predetermined phase or stage. Reconfiguration from the first configuration to the second configuration may comprise the rotation of the valve member.

The passage may be selectively alignable and/or selectively misalignable.

The passage may comprise a throughbore or throughhole.

The maximum applied cutting force may comprise an increased applied cutting force, such as an increased cutting force relative to at least one other phase or stage of the reconfiguration. The assembly may be configured to apply an increased cutting force via the valve member towards an end of a reconfiguration process between the first and second configurations.

Applying a maximum cutting force via the valve member may comprise applying a maximum torque to or through the valve member. The assembly may be configured to apply the maximum torque to the valve member at the particular phase or stage of the reconfiguration. Applying a maximum torque may comprise applying an increased torque (such as relative to another phase or stage of reconfiguration—e.g. prior to and/or after the particular stage or phase).

Applying a maximum cutting force via the valve member may comprise imparting a maximum velocity to the valve member (e.g. a maximum rotational velocity). The assembly may be configured to impart the maximum velocity to the valve member at the particular phase or stage of the reconfiguration. Imparting a maximum velocity may comprise applying an increased velocity (such as relative to another phase or stage of reconfiguration—e.g. prior to and/or after the particular stage or phase).

Applying a maximum cutting force via the valve member may comprise applying a maximum acceleration to the valve member (e.g. a maximum rotational acceleration). The assembly may be configured to apply the maximum acceleration to the valve member at the particular phase or stage of the reconfiguration. Applying a maximum acceleration may comprise applying an increased acceleration (such as relative to another phase or stage of reconfiguration—e.g. prior to and/or after the particular stage or phase).

The valve assembly may be for use in a connection between a subsea riser and a subsea wellhead. The valve assembly may connect a subsea wellhead to a subsea riser. The first conduit may be connectable to a riser. The valve assembly may comprise the first conduit. The first conduit may comprise a throughbore. The valve assembly may comprise a second conduit. The second conduit may be connectable to a wellhead or wellbore.

The apparatus may comprise one or more of: wireline, slickline, coiled tubing and/or tooling of larger diameters which, in use, pass through the passage of the valve member. The passage may be configured to receive one or more of: wireline, slickline, coiled tubing, tooling or the like. The valve member may be configured to cut any wireline, slickline, coiled tubing, tooling and/or the like extending through the passage, when the valve member is rotated between the open and closed positions.

The valve assembly may allow the use of apparatus for subsea operations where the forces required to sever such apparatus are greater, such as tubing and/or tooling having larger diameters. The valve assembly may be capable of delivering or withstanding the forces required to cut or sever tubing and/or tooling of larger diameters than other valve assemblies (e.g. other ball valve assemblies of similar diameter ball valves).

The valve assembly may be configured such that fluid may flow between the first and second conduits via the passage when the valve member is in the open position.

The valve assembly may be configured so as to prevent fluid flow through the valve assembly when the valve member is in the closed position.

The valve member may be a ball valve member. The valve member may be generally spherical.

An outer surface of the valve member may comprise at least a partially spherical outer surface.

The valve member outer surface may at least partially define an axis of rotation of the valve member. The axis of rotation of the valve member may pass through a center of a sphere defined by the valve member outer surface.

The valve assembly may extend along the longitudinal axis.

The valve member may be rotatable about a valve member rotational axis which is perpendicular to the longitudinal axis.

The valve member rotational axis may lie in a valve member center plane which is perpendicular to the longitudinal axis.

The valve member may be mounted between respective ends of the first and second conduits for rotation relative thereto.

The valve assembly may comprise an actuator arrangement.

The actuator arrangement may be biased. The actuator arrangement may comprise a biasing member. The biasing arrangement may comprise a compression member. The biasing arrangement may comprise a tension member. The biasing member may comprise one or more of: a helical spring; a Belleville spring; a resilient member; and/or the like. The biasing member may be configured to bias the valve assembly, such as via biasing of the piston, towards the second configuration.

The actuator arrangement may comprise an actuation member. The actuation member may comprise a piston. The actuator arrangement may comprise a piston member and a piston housing, wherein the piston member is configured for reciprocal motion within the piston housing. The piston may comprise an annular piston. The piston may be arranged coincident and/or collinear with the longitudinal axis. The piston may be arranged around the conduit and/or the passage. The piston may be arranged around the valve member.

The actuator may be hydraulically actuated. The actuator arrangement may be configured to be actuated by a hydraulic line isolated from the conduit and/or the passage.

The valve assembly may comprise a fail close valve. Actuation of the actuator arrangement may reconfigure the valve assembly from the first configuration to the second configuration. The valve assembly may be configured to maintain and/or move the valve assembly to the second configuration as a default configuration, such as in the event of a hydraulic supply drop, failure or cut-off. The actuator arrangement may be configured to be actuated when a fluid pressure, such as supplied by the hydraulic line, falls below a threshold. The actuator arrangement may be configured to move and/or maintain the valve assembly towards/in the first configuration prior to actuation. The actuator arrangement may comprise an actuation fluid chamber fluidly connected to a fluid supply, such as the hydraulic line. The actuation fluid chamber may be configured to bias and/or move the actuation member to the position of the first configuration when fluid/hydraulic pressure is above a threshold. The threshold may be defined at least partially by the biasing arrangement. The actuation fluid chamber may be configured and/or positioned to oppose the biasing arrangement. For example, the actuating fluid chamber may be located on an uphole side of the actuation member to act downhole on the actuation member; and the biasing arrangement may be configured to act uphole on the actuation member (e.g. by exerting a compressive force from a downhole side of the actuation member). Fluid/hydraulic actuation of the actuation arrangement, such as by reducing a supplied fluid/hydraulic pressure, may allow the biasing arrangement to move/bias the actuation member towards the second configuration.

Alternatively, the actuator arrangement may be configured to be actuated by the application of an increased hydraulic pressure via the hydraulic line. The actuator arrangement may be configured to be actuated when a fluid pressure, such as supplied by the hydraulic line, reaches or is above a threshold. Fluid/hydraulic actuation of the actuation arrangement may compensate/overcome the biasing arrangement.

The valve assembly may comprise an in-line valve assembly.

The valve assembly may be configured to minimize a footprint, such as for a rotary table. The valve assembly may be configured to pass through a rotary table. The valve assembly may be configured for lightweight intervention.

The valve assembly may comprise a linkage arrangement connecting the valve member and the actuator arrangement. The linkage arrangement may be configured to convert a linear movement of the actuation arrangement to a rotational movement of the valve member. The linkage arrangement may be configured to convert a force generated by (or received from) the actuation arrangement to a torque applied to the valve member.

The linkage member may be connected to the valve member. For example, the linkage member may be rotatably connected to the valve member. The linkage member may be connected to the actuator arrangement. For example, the linkage member may be rotatably connected to the actuator arrangement.

The linkage arrangement may be rotatably connected to the actuator arrangement. The piston member may be rotatably connected to the linkage arrangement.

The linkage arrangement may comprise a linkage member. The linkage member may comprise a boot.

The valve member and the linkage arrangement may comprise one or more complementary inter-engaging features which are configured for the transfer of torque therebetween, such as to define a coupling. The linkage member may be connected to the valve member at a position relative to the valve member rotational axis so as to permit the transfer of torque between the first linkage member and the valve member. For example, a first end of the first linkage member may be connected to the valve member at a position on the valve member rotational axis so as to permit the transfer of torque between the first linkage member and the valve member. The first linkage member may be connected to a first side of the valve member.

Such an arrangement may permit a rotational force to be transferred to the valve member from an annular piston member which is constrained to move backwards and forwards along a longitudinal direction of the valve assembly. The linkage member may be connected at a second (opposite) end to the actuation arrangement.

The linkage arrangement may comprise a coupling to the valve member. The coupling may be rotatable relative to the valve member. The linkage arrangement may be operable to eccentrically actuate the valve member by applying a force to the valve member at one or more positions located eccentrically with respect to the valve member rotational axis. The one or more positions may be defined by the coupling. The linkage arrangement may be rotatably connected to the valve member at an eccentric position offset from the valve member rotational axis.

The linkage arrangement may comprise a path of the coupling relative to the valve member. The linkage arrangement may define the path. The path may comprise a non-linear path. The path may comprise a curved path. The path may comprise an arcuate path. The path may define a pivot axis of the coupling. The path may comprise an orbit of the coupling about the pivot axis. The pivot axis may be offset relative to the rotational axis of the valve member. The pivot axis may be parallel to the rotational axis. The path may be defined by a slot or recess (such as for receiving a protrusion). Alternatively, the path may be defined by a protrusion (such as for receipt in a recess or slot). Such an arrangement may ensure that the coupling is constrained to move in an arc relative to the valve member rotational axis.

The path may be configured to convert the force generated by the actuation arrangement to a level of torque applied to the valve member according to a phase or stage of the reconfiguration of the valve assembly. The path may be configured to increase the velocity of (the rotation of) the valve member relative to the velocity of the actuation member. The path may be configured to increase the force available for cutting by the valve member towards or at the particular phase or stage. The path may be configured to relatively accelerate the valve member towards or at the particular phase or stage. The path may be configured to increase the torque applied to the valve member towards or at the particular phase or stage. The path may be configured to compensate for friction, such as frictional losses during or at the particular phase or stage and/or during or at other phases or stages of the reconfiguration.

The coupling may comprise a pin and hole arrangement. The linkage arrangement may comprise a plurality of couplings to the valve member. The linkage arrangement may comprise a pair of couplings. The pair of couplings may be opposed either side of a longitudinal plane.

The coupling may comprise a first pin which connects the valve member to the linkage arrangement at an eccentric position offset from the valve member rotational axis.

The linkage member may comprise the first pin. The first pin may extend from the linkage member and terminate in a distal end. The first pin may extend in a direction parallel to the valve member rotational axis. The first pin may extend towards or through a side face of the valve member. The first pin may fit into a corresponding recess in the valve member.

Alternatively, the valve member may comprise the first pin.

The particular phase or stage may comprise an end portion of a stroke of the actuation member. The particular phase or stage may comprise an end period. The particular phase or stage may comprise a second half of the reconfiguration (e.g. of a stroke of the actuation member and/or an angular rotation of the valve member). The particular phase or stage may comprise the last 40% and/or the last 30% and/or the last 25% and/or the last 20% and/or the last 15% and/or the last 10% and/or the last about 5% and/or the last about 3% and/or the last about 2% and/or the last about 1% of the reconfiguration.

The increase in relative velocity in the particular stage or phase may comprise a 10% increase in velocity relative to another phase or stage. The increase in velocity may comprise a 15% increase in relative velocity and optionally a 20% increase and optionally a 25% increase and optionally a 30% increase and optionally a 40% increase and optionally a 50% increase and optionally a 60% increase and optionally a 80% increase and optionally a 100% increase or more.

The increase in cutting force in the particular stage or phase may comprise a 10% increase in cutting force relative to another phase or stage. The increase in cutting force may comprise a 15% increase in relative velocity and optionally a 20% increase and optionally a 25% increase and optionally a 30% increase and optionally a 40% increase and optionally a 50% increase and optionally a 60% increase and optionally a 80% increase and optionally a 100% increase or more.

The other phase or stage may be a phase or stage immediately prior to the particular phase or stage.

Reconfiguration from the first to the second configuration may comprise rotating the valve member through at least about 90 degrees.

The valve assembly may comprise a housing. The housing may be generally tubular.

The first and/or second conduits may comprise passages formed within the housing. The first and/or second conduits may comprise a tubular member, a pipe or the like. At least a portion of the first and/or second conduits may be located within the housing.

The valve member may comprise a cutting edge configured to cut wireline, slickline, coiled tubing, tooling or the like. The cutting edge may be located on or adjacent an outer surface of the valve member at or adjacent one end of the passage. The cutting edge may be heat treated. This may provide a cutting edge such as a hardened cutting edge which may more easily shear wireline, slickline, coiled tubing, tooling and/or the like which passes through the through-hole and/or may apply higher shear forces to wireline, coiled tubing or tooling.

The cutting edge may be formed integrally with the valve member.

The cutting edge may be separately formed from the valve member and later attached to the valve member. The cutting edge may comprise a sheet of material which is shaped to conform with an outer surface of the valve member. The cutting edge may have an aperture formed therein. The aperture in the cutting edge may be aligned with one end of the passage. The cutting edge may be attached to the valve member by one or more fasteners such as bolts. The valve member may have one or more counterbores formed therein, wherein each counterbore receives a head of a corresponding fastener used to attach a cutting edge to the valve member.

The valve member may comprise a relief slot, recess or the like formed in the valve member at an end of the passage opposite to an end of the passage at which the cutting edge is located. Such a relief slot may be configured to accommodate the apparatus so as to prevent cutting thereof at the end of the passage opposite to the end of the passage at which the cutting edge is located. Such a relief slot may serve to avoid a dual cutting sequence of the apparatus and thereby eliminate the formation of a segment of apparatus (e.g. a slug of wireline, slickline, coiled tubing, tooling and/or the like) which could potentially fall into the well and be difficult to retrieve. Such a relief slot may provide for a concentration or maximization of cutting force (e.g. dual cutting may otherwise diminish the available cutting force at a particular or single cutting edge, such as effectively halving the cutting force by distributing the torque between two cutting edges or locations).

Alternatively, the assembly may be configured for dual cutting of the apparatus. For example, the valve member may be provided with a cutting edge at each end of the passage.

The valve member may comprise a metal. The valve member may comprise nickel. The valve member may comprise chromium. The valve member may have a fine surface finish such as a polished outer surface finish or the like.

The valve assembly may comprise at least one valve seat. The valve seat may be fixed relative to the housing. The valve seat may be configured to support the valve member. The valve seat may comprise a surface configured to engage an outer surface of the valve member. For example, the valve seat may comprise an inner surface configured to engage at least a portion of a spherical or partially-spherical outer surface of the valve member.

The valve assembly may comprise two valve seats arranged diametrically opposite one another with respect to a longitudinal axis of the valve assembly for supporting the valve member. Each valve seat may comprise first and second parts. The first valve seat part may be located to one side of the valve member center plane and the second valve seat part may be located to the other side of the valve member center plane. Splitting a valve seat into two parts may simplify assembly of the valve assembly.

The valve assembly may comprise a bush. The bush may be configured to support and accommodate rotation of the valve member within the housing of the valve assembly. The bush may cooperate with substantially planar sides of the valve member to ensure rotation of the valve member about the rotation axis (e.g. to define a single rotation axis through the center defined by the partial spherical outer surface of the valve member).

In use, the valve assembly may be reconfigured by increasing a pressure differential across the actuating arrangement, such as by applying an increased hydraulic pressure to a first side of the piston. The increased pressure differential acting across a first sealing area of the actuating arrangement may generate a proportional linear force. Accordingly a portion (e.g. the piston) of the actuating arrangement may move longitudinally (e.g. uphole or downhole). The linear movement of the actuating arrangement may be converted to a rotational movement of the valve member by the linkage arrangement. The linkage arrangement may be so configured that the linear movement of the actuating arrangement is converted to a rotational movement of the valve member with an increased torque towards the particular stage or phase (e.g. towards the end of the linear movement and/or corresponding to when the valve member engages or approaches engagement with the valve seat) such as to provide an increased cutting force to cut or sever apparatus in the passage (or in the passage prior to reconfiguration).

When compared with known valve assemblies, the valve assembly may deliver larger forces, such as required for severing wireline, slickline, coiled tubing and/or tooling of larger diameters which, in use, pass through the passage of the valve member.

The valve assembly may be reconfigurable to a third configuration. The third configuration may comprise a pump through configuration, such as to supply equipment and/or fluid/s downhole of the valve. The third configuration may be subsequent to a previous reconfiguration of the valve assembly from the first to the second configuration (e.g. moving the valve member from the open to the closed position). The valve assembly may be reconfigurable from the second to the third configuration by applying a change in pressure differential across the actuating member. For example, the valve assembly may be reconfigurable to the third configuration by applying an increased conduit or throughbore pressure, such as from uphole.

The valve assembly may comprise a deactuation arrangement, such as to reconfigure the valve assembly to the third configuration. The deactuation arrangement may comprise a counterpiston. The counterpiston may comprise a first counterpiston fluid chamber in fluid communication with a conduit pressure, such as an uphole fluid pressure. The counterpiston may be configured engage the actuation arrangement and or the linkage arrangement to counter-rotate the valve member away from the second configuration. The counterpiston may be configured to overcome a pressure differential acting across the actuation member and/or the biasing force, such as to overcome at a particular pressure differential threshold (e.g. achieved by an increased uphole fluid pressure). The counterpiston may comprise a conduit fluid seal at a greater diameter than the valve member (e.g. a greater diameter than the valve seat/s). Accordingly the counterpiston may experience a greater force at a similar fluid pressure. The first counterpiston fluid chamber may be in fluid communication with the first conduit and/or the valve member, such as an uphole side of the valve member.

The valve assembly may be configured to apply a greater force for rotation of the valve member towards the closed position compared with a force applied by the actuator arrangement via the linkage arrangement for rotation of the valve member towards the open position.

According to a further aspect of the invention, there is provided a method of operating a valve assembly comprising: configuring the valve assembly to a first configuration such that a passage in a rotatable valve member is aligned with a first conduit; reconfiguring the valve assembly towards a second configuration so as to misalign the valve member passage with the first conduit; and applying a maximum cutting force via the valve member at a particular phase or stage during the reconfiguration so as to cut or sever and/or clamp apparatus present in the valve member passage.

Reconfiguration may comprise rotating the valve member relative to the first conduit.

According to a further aspect of the present invention there is provided a wellbore valve assembly comprising: a rotatable valve member having a passage formed therein, the passage being alignable with a first conduit in a first configuration, and the passage being misalignable with the first conduit in a second configuration, wherein the valve assembly may is reconfigurable between the first configuration such that a maximum cutting force is applied via the valve member at a particular phase or stage of the reconfiguration to cut or sever and/or clamp apparatus present in the valve member passage.

The invention includes one or more corresponding aspects, embodiments or features in isolation or in various combinations whether or not specifically stated (including claimed) in that combination or in isolation. For example, features associated with particular recited embodiments relating to one valve assembly, may be appropriate as features of embodiments relating to another valve assembly, and vice versa. As will be appreciated, features associated with particular recited embodiments relating to methods, may be appropriate as features of embodiments relating specifically to apparatus, and vice versa.

It will also be appreciated that one or more embodiments/aspects may be useful for providing a valve assembly for wellbore operations.

The above summary is intended to be merely exemplary and non-limiting.

BRIEF DESCRIPTION OF THE DRAWINGS

The present invention will now be further described by way of non-limiting example only with reference to the following drawings of which.

DETAILED DESCRIPTION

Figure 2:
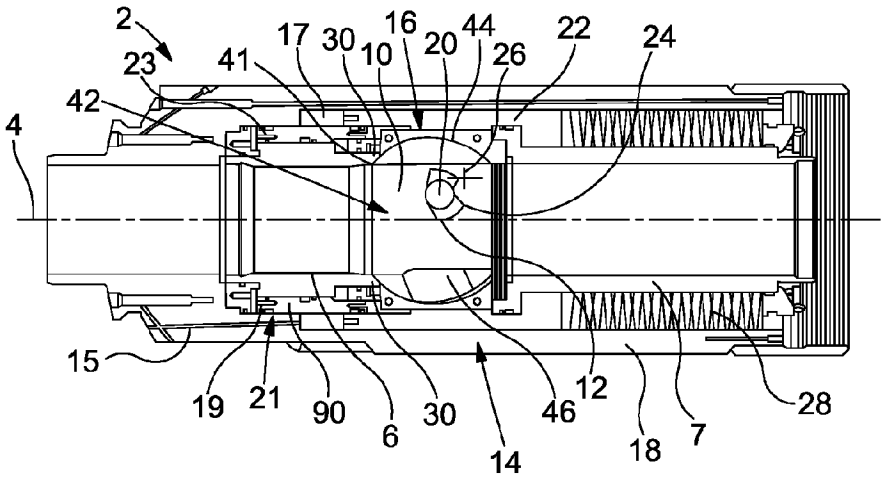
FIG. 2 is a longitudinal cross-sectional view of the valve assembly of FIG. 1 when the valve member is in the open position.
Figure 3:
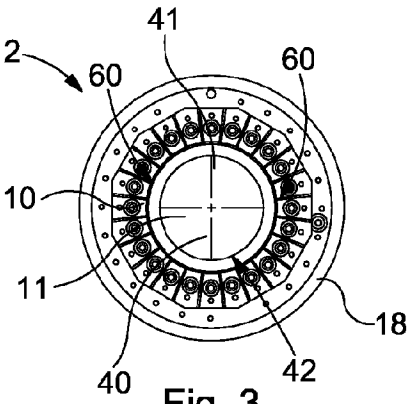
FIG. 3 is an end view of the valve assembly of FIG. 1 when the valve member is in the open position.
Figure 1:
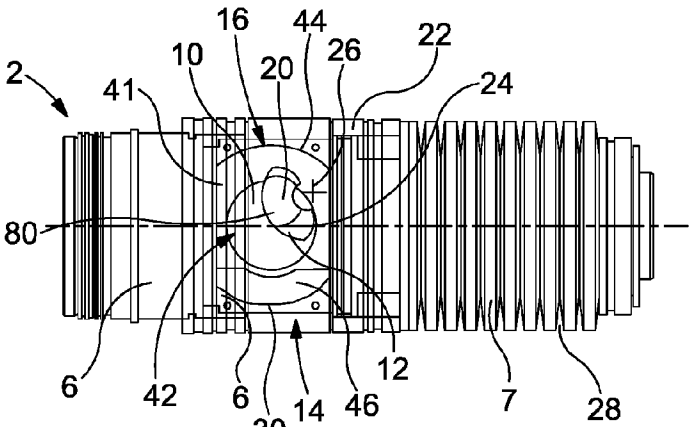
FIG. 1 is a side view of a valve assembly after removal of a housing when a valve member is in an open position.
Figure 5:
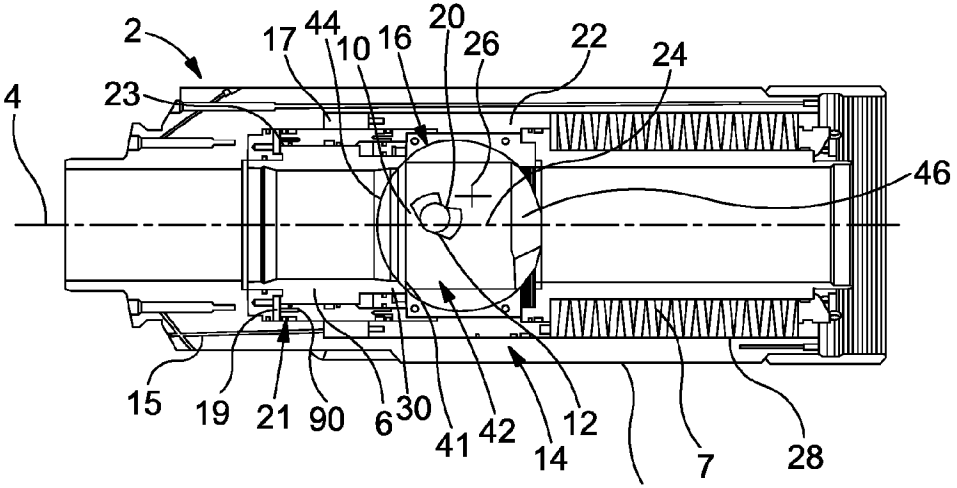
FIG. 5 is a longitudinal cross-sectional view of the valve assembly of FIG. 4 when the valve member is in the closed position.
Figure 6:
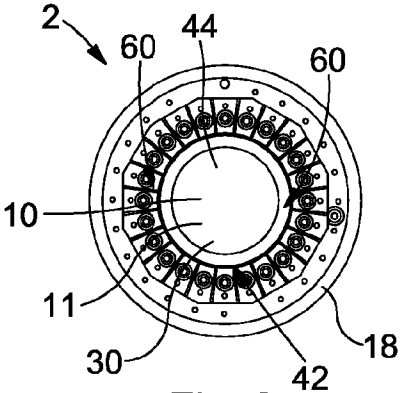
FIG. 6 is an end view of the valve assembly of FIG. 4 when the valve member is in the closed position.

Referring initially to FIGS. 1, 2 and 3, there is shown a valve assembly generally designated 2 for use in a connection between a subsea riser (not shown) and a subsea wellhead (not shown) as part of a subsea lightweight riser intervention system. The valve assembly 2 extends along a longitudinal axis 4. The valve assembly 2 comprises first and second conduits 6, 7.

Figure 4:
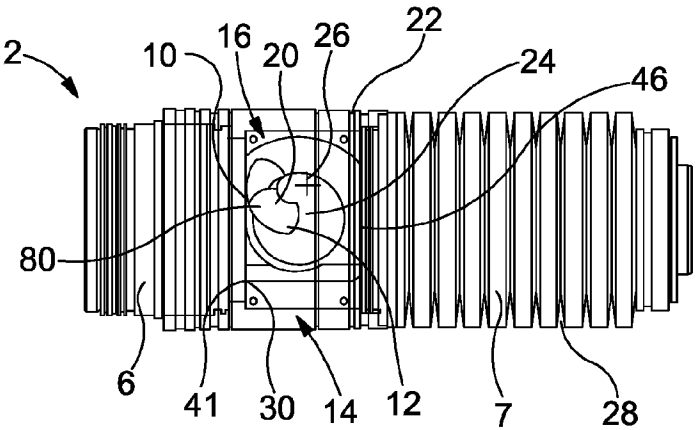
FIG. 4 is a side view of the valve assembly of FIG. 1 when the valve member is in a closed position.
Figure 6C:
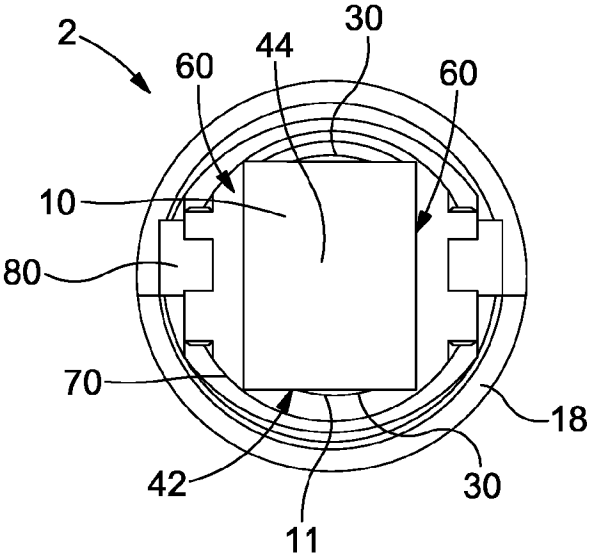
FIG. 6*c* is cross-sectional axial view of the valve assembly of FIG. 4 when the valve member is in the closed position.
Figure 6B:
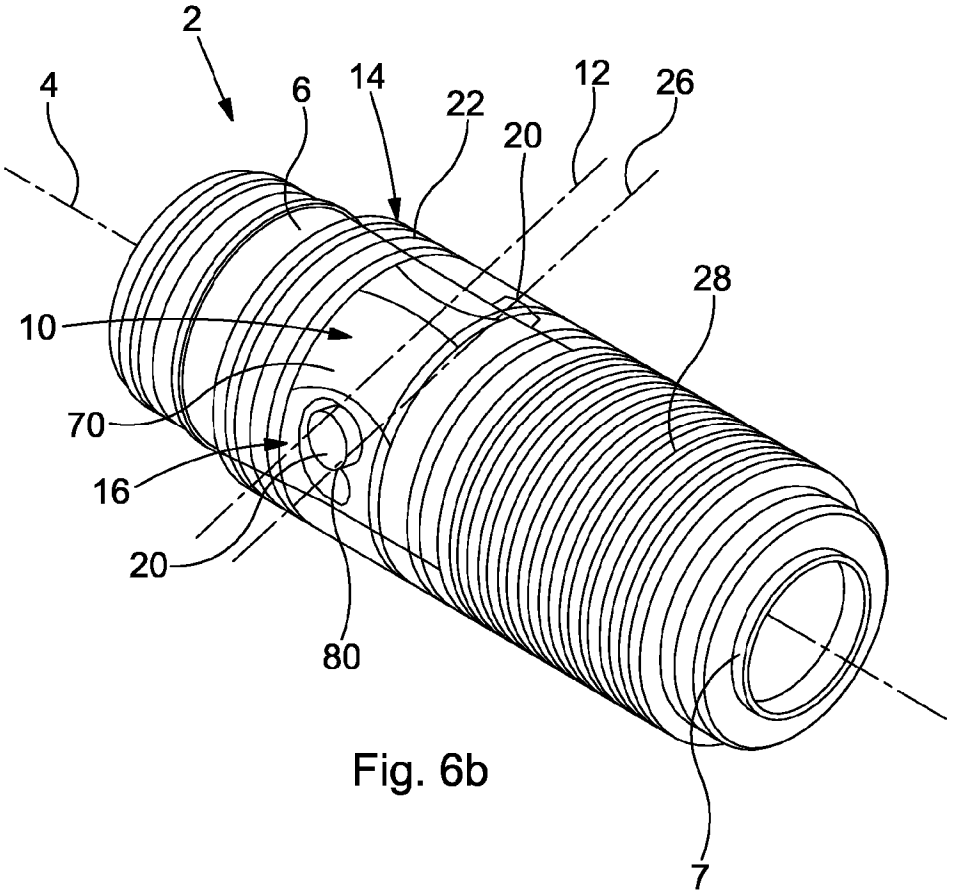
FIG. 6*b* is a perspective view of the valve assembly of FIG. 4 when the valve member is in the closed position.

The valve assembly 2 comprises a rotatable generally spherical valve member 10 mounted between respective ends of the first and second conduits 6, 7 within the housing for rotation about a valve member rotational axis 12. It should be noted that some components, such as the housing, have been omitted from FIG. 1 (and FIGS. 4 and 7) for clarity. The valve member rotational axis 12 lies in a valve member center plane which is perpendicular to the longitudinal axis 4. An outer surface of the valve member 10 comprises at least a partially spherical outer surface. The valve member outer surface at least partially defines the axis of rotation 12 of the valve member 10, which passes through a center of the sphere defined by the valve member outer surface.

The valve member 10 comprises a passage 11 in the form of a through-hole 40 which is aligned with the respective ends of the first and second conduits 6, 7 when the valve member 10 is in an open position. In use, apparatus such as a wireline, a slickline, coiled tubing, intervention tooling and/or the like may extend through the first and second conduits 6, 7 and the passage when the valve member 10 is in the open position. For example, as can be clearly seen in FIGS. 2 and 3, the valve member 10 is in the open position and apparatus (not shown) could extend through the first and second conduits 6, 7 and the through-hole of the valve member 10. In some embodiments, the apparatus (e.g. coiled tubing) may have a larger diameter than conventional apparatus. The valve assembly 2 is configured so that the valve member 10 cuts the apparatus when the valve member 10 is rotated towards a closed position.

The valve assembly 2 comprises an actuator arrangement 14 which is rotatably connected to a linkage arrangement 16. The linkage arrangement 16 comprises a boot 80 with a coupling 20 connected to the valve member 10. It will be appreciated that in the embodiment shown, the linkage arrangement comprises a pair of couplings 20 to the valve member 10, a second coupling being mirrored about the plane of the paper from the first coupling 20. The actuator arrangement 14 comprises a piston 22 (shown transparent in FIGS. 1, 4, 15 and 7 to 12). In the embodiment shown, the piston 22 comprises an arcuate slot 24 that defines a path for the coupling 20. Here, the coupling 20 comprises a pin that extends through the slot 24 and into a circular hole within a planar side face 60 of the valve member 10 arranged perpendicular to the valve member rotational axis 12. The valve assembly 2 comprises a bush 70 to support and accommodate rotation of the valve member 10 within the housing 18 of the valve assembly 2. The bush 70 cooperates with the substantially planar sides 60 of the valve member 10 to ensure rotation of the valve member 10 about the rotation axis 12 (e.g. to define a single rotation axis through the center defined by the partial spherical outer surface 44 of the valve member 10).

The slot 24 defines an arcuate path for the coupling 20 about a pivot axis 26. The pivot axis 26 is offset from the rotational axis 12 of the valve member. Movement of the coupling 20 along the path defined by the slot 24 causes the valve member 10 to rotate about the rotational axis 12.

The actuator arrangement 14 is housed generally within a tubular actuator arrangement housing 18. The piston 22 engages a biasing member 28 in the form of Belleville springs in the embodiment shown. The biasing member 28 urges the piston 22 away from the first configuration. Here, the biasing member 28 biases the piston 22 uphole (to the left in FIG. 1). However, a fluid pressure differential across the piston 22 in FIGS. 1 to 3 causes the piston 22 to overcome the biasing force, maintaining the piston 22 in the first configuration and the valve assembly 2 open in FIGS. 1 to 3. Here, a fluid pressure differential acting on the piston 22 is provided by a higher fluid pressure acting downhole on an uphole side of the piston (the left) than the biasing member's 28 force acting uphole on a downhole side of the piston 22 (the right); and any uphole fluid pressure force (e.g. from fluid in the biasing member's 28 chamber.

In the embodiment shown, the valve assembly 2 comprises a fail close valve. The piston 22 is hydraulically actuated. Here, the actuator arrangement 14 is actuated by a hydraulic line 15 isolated from the conduits 6, 7 and the passage 11. It will be appreciated that, although shown here with crossbores for manufacture, the hydraulic line 15 is fluidly isolated to communicate with a hydraulic source, such as an uphole, isolated hydraulic source (not shown). Actuation of the actuator arrangement 14 reconfigures the valve assembly from the first configuration to the second configuration. The actuator arrangement 14 is hydraulically actuated when a fluid pressure, such as supplied by the hydraulic line 15, falls below a threshold. The valve assembly 2 is configured to maintain and/or move the valve assembly 2 in/to the second configuration as a default configuration, such as in the event of a hydraulic supply drop, failure or cut-off. The actuator arrangement 14 moves and maintains the valve assembly 2 towards the first configuration prior to actuation. The actuator arrangement 14 comprises an actuation fluid chamber 17 fluidly connected to the hydraulic line 15. The actuation fluid chamber 17 biases and moves the piston 22 to the position of the first configuration when hydraulic pressure is above a threshold. Here, the threshold is effectively defined by the biasing member 28, with minimal or negligible fluid pressure acting to bias the piston 22 uphole. The actuation fluid chamber 17 is positioned to oppose the biasing member 28, located on an uphole side of the piston 22 to act downhole on the piston 22; and the biasing member 28 acts uphole on the piston 22 (e.g. by exerting a compressive force from a downhole side of the piston 22).

The valve member 10 is secured within the housing by valve seats 30. Each valve seat 30 has an inner surface which is configured to engage a portion of the spherical outer surface of the valve member 10.

The through-hole 40 is configured to accommodate one or more objects such as a wireline, a slickline, coiled tubing, intervention tooling and/or the like. The through-hole 40 extends from an aperture 42 where the through-hole 40 meets an outer surface 44 of the valve member 10 at a leading side of the valve member 10 to a relief slot 46 formed in the outer surface 44 of the valve member 10 at a trailing side of the valve member 10 opposite the leading side. The aperture 42 is configured for cutting the wireline, slickline, coiled tubing, intervention tooling and/or the like which extends through the through-hole 40. The valve member 10 comprise a cutting edge 41 configured to cut wireline, slickline, coiled tubing, tooling or the like. The cutting edge 41 is located on or adjacent the outer surface 44 of the valve member at or adjacent an uphole end of the passage 11. The relief slot 46 is configured to prevent the wireline, slickline, coiled tubing, intervention tooling and/or the like from being severed at the trailing side so as to avoid a segment of wireline, slickline, coiled tubing, intervention tooling and/or the like being formed when the valve member 10 is rotated to the closed position. This may be advantageous because such a segment of wireline, slickline, coiled tubing, intervention tooling and/or the like may fall into the well where it may be difficult to retrieve and/or cause damage.

When the valve assembly 2 is to be closed, such as in an emergency or shut-off situation, the forces acting across the piston 22 are adjusted such that the piston 22 moves longitudinally (uphole, to the left, as shown here). Here, the change in forces is provided by hydraulic actuation of the actuation arrangement 14 by reducing the hydraulic pressure from hydraulic line 15. Accordingly, the downhole force applied to the piston 22 from the actuation fluid chamber 17 drops below the threshold. Accordingly, the downhole force (acting on the piston 22 as result of fluid pressure on the uphole side of the piston 22) is overcome by the biasing member 28 and the piston 22 translates (shown here as uphole linear translation to the left), moving the piston 22 towards the second configuration as shown in FIGS. 4, 5, 6, 6*b* and 6*c*.

Movement of the piston 22 results in rotation of the valve member 10 via the movement of the coupling 20 as defined by the slot 24. Accordingly, the valve member 10 is rotated to the second configuration, a valve closed configuration, with the valve member 10 rotated through 90 degrees about the valve member rotational axis 12 in an anti-clockwise direction to cut any apparatus in the passage 11, as shown in FIGS. 4 to 6*c*. Towards the end of reconfiguration, the cutting edge 41 engages one or a portion of the uphole valve seats 40.

Figures 7, 8, 9, 10, 11, 12:
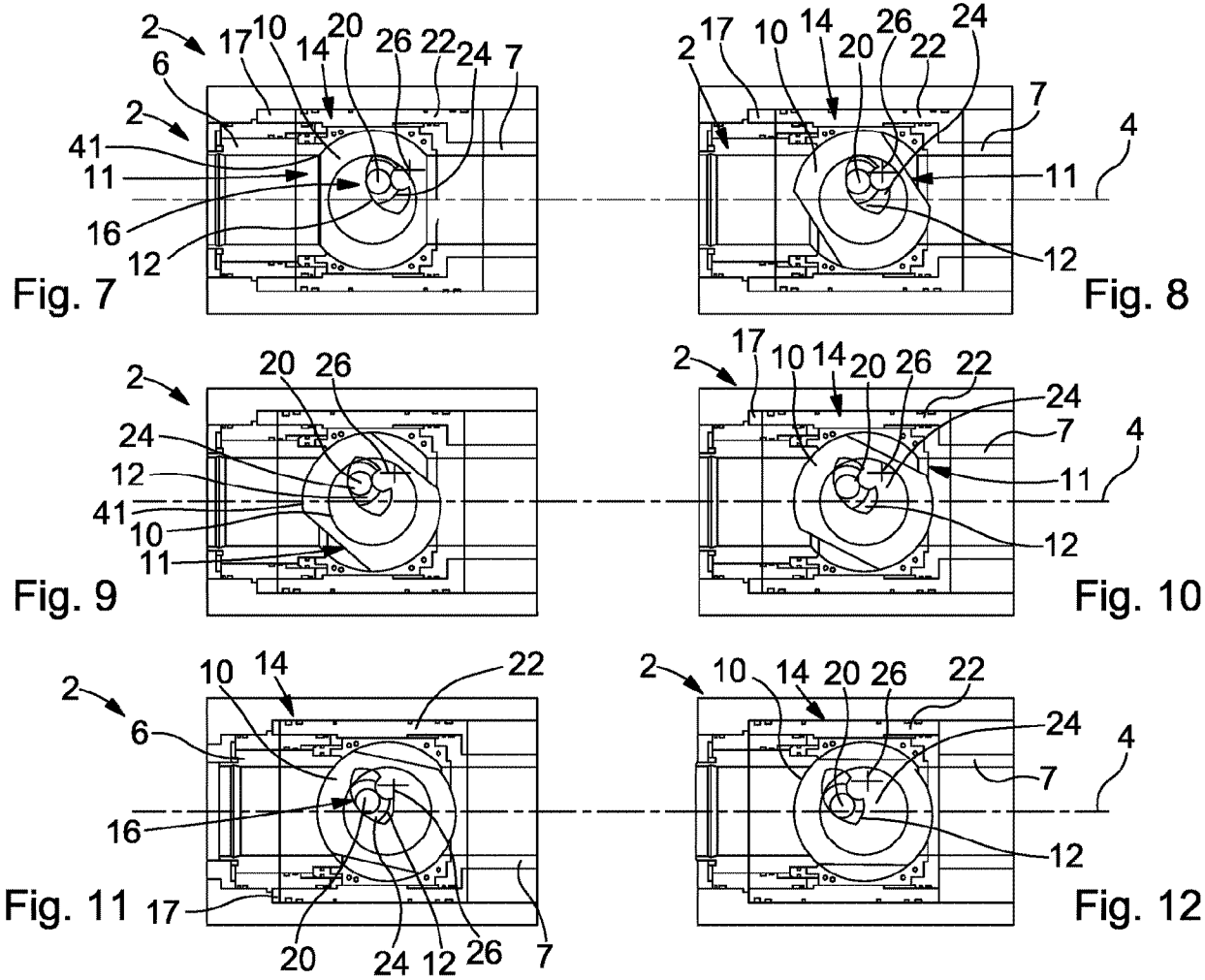
FIG. 7 is a schematic view of the valve assembly of FIG. 1 when the valve member is in the open position.
FIG. 8 is a schematic view of the valve assembly of FIG. 1 when the valve assembly is in a first intermediate position.
FIG. 9 is a schematic view of the valve assembly of FIG. 1 when the valve assembly is in a second intermediate position.
FIG. 10 is a schematic view of the valve assembly of FIG. 1 when the valve assembly is in a third intermediate position.
FIG. 11 is a schematic view of the valve assembly of FIG. 1 when the valve assembly is in a fourth intermediate position.
FIG. 12 is a schematic view of the valve assembly of FIG. 4 when the valve assembly is in the closed position.

FIGS. 7 to 12 schematically illustrate the progression of the valve assembly from the first configuration of FIGS. 1 to 3 (shown in FIG. 7) to the second configuration of FIGS. 4 to 6*c* (shown in FIG. 12). FIGS. 8, 9, 10 and 11 show progressive relative sequential movement of the actuation arrangement 14, the linkage arrangement 16 resulting in the progressive sequential intermediate positions of the valve member 10.

In the embodiment shown, reconfiguration of the valve assembly 2 from the first configuration to the second configuration seals the valve assembly 2 such that fluid passage or transit through the valve assembly is prevented. When the valve member 10 seats in the valve seat 40 a seal is formed, preventing the passage of fluid downhole and in particular preventing the passage of fluid uphole (such as in a shut off situation where downhole pressure may be dangerously high).

Figure 14:
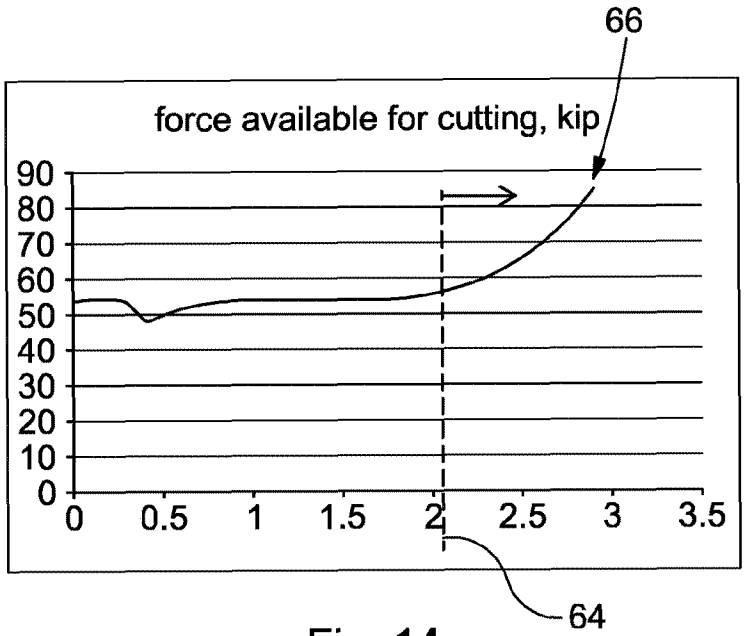
FIG. 14 is a graph illustrating a cutting force available via the valve member of FIG. 1 during movement of the valve member from the open position to the closed position.
Figure 13:
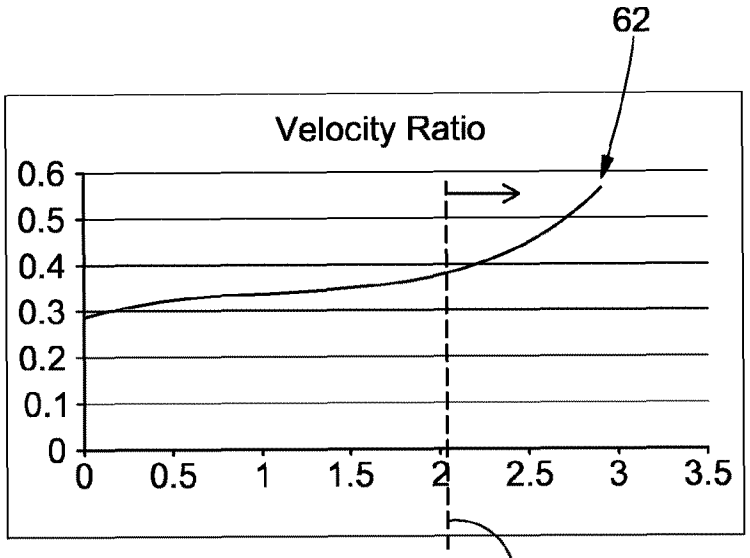
FIG. 13 is a graph illustrating a velocity ratio of the valve member of FIG. 1 relative to an actuation member of the valve assembly of FIG. 1 during movement of the valve member from the open position to the closed position.

FIG. 13 shows a graph illustrating a velocity ratio of the valve member 10 relative to the piston 22 during movement of the valve member 10 from the open position at the left hand vertical axis of the graph to the closed position at the right hand end of the curve. As can be seen, the velocity ratio undergoes a slight initial increase, such as may be attributable to static and/or dynamic frictional influences. Thereafter for much of the reconfiguration from the open to the closed configurations, the velocity ratio remains substantially constant or undergoes a minor increase. Towards the end of the reconfiguration, at around two thirds of the reconfiguration (here, in both time and piston 22 stroke), the velocity ration increases to a maximum right at the end of the reconfiguration. It will be appreciated that the graph of FIG. 13 is unitless, relating to a relative velocity ratio (albeit rotational against linear). FIG. 14 shows a corresponding graph illustrating the cutting force available via the valve member 10 during movement of the valve member 10 from the open position to the closed position. Here, a maximum cutting force in excess of 80 kip (kilopounds force) is achieved at a particular phase or stage of the reconfiguration. In the embodiment shown, the particular phase or stage is indicated to the right of vertical lines 60, 64 (towards the end 25% of the reconfiguration) and the maxima at respective endpoints 62, 66. Such increases to maxima 62, 66 are resultant from the linkage arrangement's 16 conversion of the actuator arrangement's 14 linear movement to the rotational movement of the valve member 10 as defined by the arcuate slot 24 positioned to offset the pivot axis 26 relative to the rotational axis 12.

Accordingly, the valve member 10 experiences increased and maximum torque, velocity and cutting force towards the end of the reconfiguration, coinciding with the closure of the cutting edge 41 on the valve seat 40. Accordingly, maximum cutting force is available to cut or sever any apparatus in the passage when such apparatus is most likely to be compressed between the cutting edge 41 and the valve seat 40 (e.g. when the diameter of the passage is minimized, such as to less than that of the apparatus). Accordingly increased security or reliability of operation may be provided and/or apparatus with increased required cutting forces may be safely deployed in the passage 11.

Figure 16:
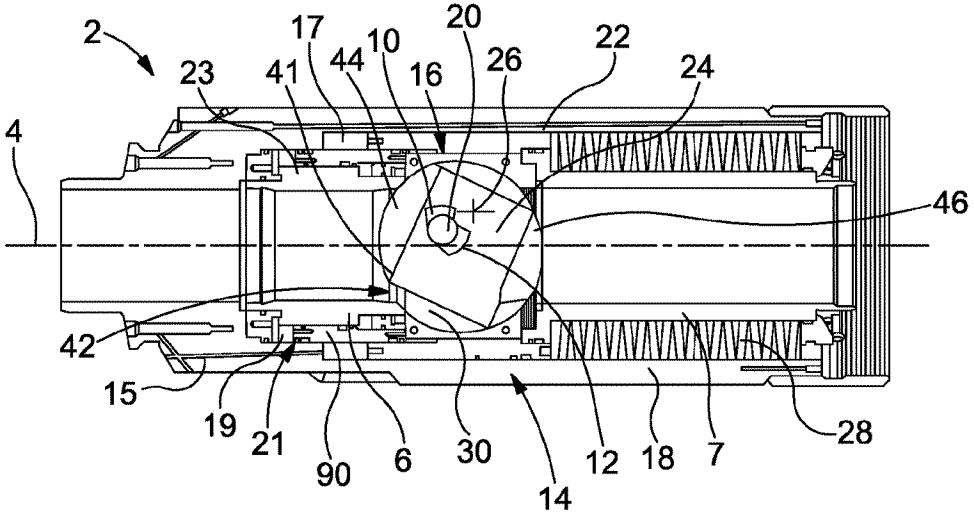
FIG. 16 is a longitudinal cross-sectional view of the valve assembly of FIG. 4 when the valve member is in the closed position when the valve assembly is in a third configuration, with the valve member in the pump through position.
Figure 15:
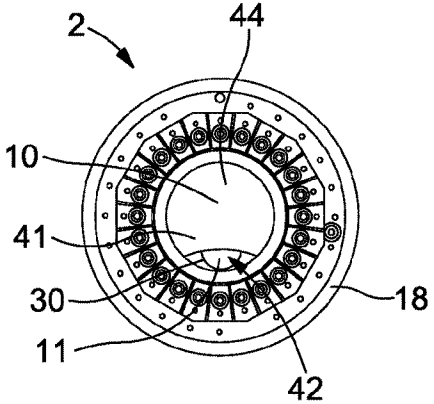
FIG. 15 is a side view of the valve assembly of FIG. 1 when the valve assembly is in a third configuration, with the valve member in a pump through position.
Figure 17:
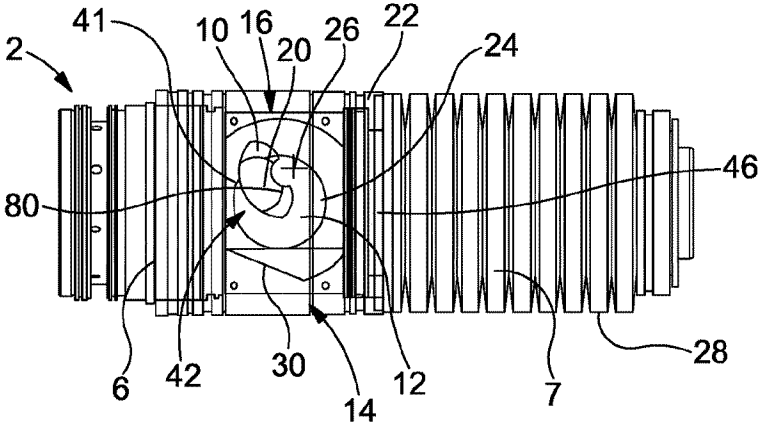
FIG. 17 is an end view of the valve assembly of FIG. 4 when the valve assembly is in a third configuration, with the valve member in the pump through position.

FIGS. 15, 16 and 17 show the valve assembly 2 in a third configuration, with the valve member 10 in a pump through position. Although the valve member 10 position shown in FIGS. 15, 16 and 17 may be generally similar to the fourth intermediate position shown in FIG. 11, it will be appreciated that movement (clockwise) of the valve member 10 has been achieved in FIGS. 15, 16 and 17 by the application of an increased fluid pressure from uphole (the left) via a deactuation arrangement 21. The deactuation arrangement 21 comprises a first counterpiston fluid chamber 19 in fluid communication with the conduit pressure and uphole fluid pressure such that an increased fluid pressure from uphole communicates with an uphole side of a counterpiston 90. A downhole side of the counterpiston 90 is in fluid communication with the actuation fluid chamber 15. When the conduit/uphole fluid pressure increases above fluid pressure in the actuation fluid chamber 15, the pressure differential across the counterpiston 90 causes the counterpiston 90 to move downhole. Movement of the counterpiston downhole causes the counterpiston 90 to engage the piston 22 via a flange or shoulder 92. Sufficient conduit/uphole fluid pressure allows the counterpiston 90 to overcome a piston force threshold otherwise urging the piston 22 uphole (attributable effectively to the biasing force of the biasing member 28 as the fluid pressure in the actuation chamber 15 is negligible or has already been overcome). The counterpiston 90 engages the piston 22 to move the linkage arrangement 16 to counter-rotate the valve member 10 away from the second configuration of FIGS. 4 to 6 to the third configuration of FIGS. 15 to 17. The counterpiston 90 comprises a conduit fluid seal 19 at a greater diameter than the valve member 10 (e.g. a greater diameter than the valve seats 30). Accordingly the counterpiston 90 experiences a greater force at a similar fluid pressure. With the counterpiston 90 engaging the piston 22 to at least partially align the passage 11, breaking the seal with the valve seats 30, the first and second conduits 6, 7 are again in fluid communication and fluid or tools may pass through the valve assembly 2. Accordingly, operations may be performed, such as to address the situation that caused the actuation of the valve assembly 10 to cut off the wellbore (e.g. inject fluids to address overpressure).

The applicant hereby discloses in isolation each individual feature described herein and any combination of two or more such features, to the extent that such features or combinations are capable of being carried out based on the present specification as a whole in the light of the common general knowledge of a person skilled in the art, irrespective of whether such features or combinations of features solve any problems disclosed herein, and without limitation to the scope of the claims. The applicant indicates that aspects of the present invention may consist of any such individual feature or combination of features. In view of the foregoing description it will be evident to a person skilled in the art that various modifications may be made within the scope of the invention.

What is claimed is:

1. A valve assembly for wellbore, downhole or intervention operations, the valve assembly comprising:

a rotatable ball valve member having a passage formed therein;

an actuator arrangement; and a linkage arrangement comprising a boot with a coupling to the valve member, the linkage arrangement connecting the valve member and the actuator arrangement, wherein actuation of the actuator arrangement reconfigures the valve assembly from a first configuration in which the passage is aligned or alignable with a first conduit to a second configuration in which the passage is misaligned or misalignable with the first conduit, so as to cut or sever one or more apparatuses present in the valve member passage prior to reconfiguration; and wherein the linkage arrangement is configured to convert a linear movement of the actuation arrangement to a rotational movement of the valve member, the linkage arrangement defining an arcuate path of the coupling relative to the valve member, the arcuate path defining a pivot axis of the coupling, the pivot axis being offset relative to a rotational axis of the valve member such that the path comprises an orbit of the coupling about the pivot axis such that the assembly is configured to apply a maximum cutting force at a particular phase or stage of the reconfiguration.

2. The valve assembly according to claim 1, wherein the passage is alignable with a longitudinal axis of the first conduit such that fluid and/or the one or more apparatuses are configured to pass through the valve assembly, and wherein the passage is misalignable with the longitudinal axis of the first conduit such that a passage/transit of a fluid and/or the one or more apparatuses through the valve assembly is substantially prevented or at least impeded.

3. The valve assembly according to claim 1, wherein the valve assembly is configured to apply the maximum cutting force via the valve member, when the maximum cutting force is required to cut or sever the one or more apparatuses present in the valve member passage prior to reconfiguration.

4. The valve assembly according to claim 1, wherein the particular phase or stage corresponds to a dimension of the one or more apparatuses to be passed through the passage.

5. The valve assembly according to claim 1, wherein the first configuration comprises a valve open position and the second configuration comprises a valve closed position.

6. The valve assembly according to claim 1, wherein reconfiguration of the valve assembly from the first configuration to the second configuration seals the valve assembly such that passage/transit of a fluid and/or the one or more apparatuses through the valve assembly is substantially prevented.

7. The valve assembly according to claim 1, wherein reconfiguration from the first configuration to the second configuration comprises the rotation of the valve member.

8. The valve assembly according to claim 1, wherein the valve assembly is configured to apply an increased cutting force, relative to the cutting force applied at least one other phase or stage of the reconfiguration, via the valve member towards an end of a reconfiguration process between the first and second configurations.

9. The valve assembly according to claim 1, wherein applying the maximum cutting force via the valve member comprises imparting a maximum velocity to the valve member and/or a maximum acceleration to the valve member, and/or a maximum torque to or through the valve member.

10. The valve assembly according to claim 1, wherein an outer surface of the valve member at least partially defines an axis of rotation of the valve member.

11. The valve assembly according to claim 1, wherein the valve member is rotatable about the valve member rotational axis which is perpendicular to a longitudinal axis of the first conduit.

12. The valve assembly according to claim 1, wherein the actuator arrangement is hydraulically actuated.

13. The valve assembly according to claim 1, wherein the actuator arrangement is biased.

14. The valve assembly according to claim 1, wherein an increase in cutting force at the particular stage or phase of the configuration is a 20% or more increase, or a 40% or more increase, in cutting force relative to another phase or stage.

15. The valve assembly according to claim 1, wherein the valve member comprises a cutting edge configured to cut wireline, slickline, coiled tubing, tooling or the like, the cutting edge is configured to be located on or adjacent an outer surface of the valve member at or adjacent one end of the passage.

16. The valve assembly according to claim 1, comprising at least one valve seat, the valve seat configured to support the valve member.

17. The valve assembly according to claim 1, wherein the valve assembly is reconfigurable to a third configuration by way of a deactuation arrangement, subsequent to a previous reconfiguration of the valve assembly from the first to the second configuration.

18. The valve assembly according to claim 1, for use in a connection between a subsea riser and a subsea wellhead, wherein the first conduit of the valve assembly is connectable to the riser, and the valve comprises a second conduit, the second conduit connectable to the wellhead.

* * * * *